United States Patent [19]

Otani

[11] 4,362,376

[45] Dec. 7, 1982

[54] FILM PROCESSOR WITH A BY-PASS TRANSFERRING MECHANISM

[75] Inventor: Masami Otani, Kyoto, Japan

[73] Assignee: Dainippon Screen Mfg. Co., Ltd., Kyoto, Japan

[21] Appl. No.: 262,398

[22] Filed: May 11, 1981

[30] Foreign Application Priority Data

May 22, 1980 [JP] Japan ..... 55-71604

[51] Int. Cl.[3] ..... G03D 3/08

[52] U.S. Cl. ..... 354/319; 354/339; 134/64 P

[58] Field of Search ..... 354/316, 319, 320, 321, 354/322, 338, 339; 134/64 P, 122 P

[56] References Cited

U.S. PATENT DOCUMENTS 3,699,869 10/1972 Jensen ..... 354/321

3,785,269 1/1974 Morioka ..... 354/322

*Primary Examiner*—L. T. Hix

*Assistant Examiner*—Alan Mathews

*Attorney, Agent, or Firm*—Brumbaugh, Graves, Donohue & Raymond

[57] ABSTRACT

Two transfer routes for exposed films are provided in a film processor, in one of the two ordinary films which require treatments of developing, stopping, fixing and washing with being transferred, and in the other route wash-off films which require only a treatment of the washing with being transferred. The ordinary films are transferred through the former route with being treated several processes, and the other hand, the wash-off films are directly transferred into a washing tray through the latter route, skipping over treatments of developing, stopping and fixing.

The by-pass mechanism for wash-off films can be swinged around a shaft, by which the maintenance for the film processor becomes easier. Processing for different kinds of films can be performed, depending on the kind of films to be processed, with a film processor.

6 Claims, 3 Drawing Figures

FILM PROCESSOR WITH A BY-PASS TRANSFERRING MECHANISM

BACKGROUND OF THE INVENTION

The present invention relates to a film processor for different kinds of films which require different processing treatments.

With a processor, a photographic film is normally subjected to four to five treatments one after another such as developing, stopping, fixing, washing and drying, and a film supplied from one end of the processor is transferred continuously along a certain route to be subjected to the foregoing treatments respectively and to be discharged from the other end thereof after treatment. Either one of the different kinds of films, ordinary films and wash-off films, which require different treatments for processing, can be handled without any troublesomeness. Even for ordinary films, it is necessary to change the developing solution supplied in a developing tray prior to the treatment of respective exposed films depending on the kind of the film, that is a lith-type film developed to a high contrast of black and white or a continuous tone film developed to a continuous gradation from white to black. All of the films are inserted from the inlet at an end of the processor to be subjected to the respective treatments of developing, fixing and washing and also to the stop treatment as required in a stop bath provided between the processes of developing and fixing. While passing through the drying chamber placed after the washing tray, the films are dried, then are discharged from the outlet at the other end thereof, and all the films are transferred along the same route. Wash-off films, however, are subjected to the two treatments of processing by activator and washing only, which is in a marked contrast to the treatments for ordinary films which require the developing, stopping, fixing and washing. For the processing with the foregoing processor, therefore, it is necessary to provide two washing units, one next to the other, and to transfer the wash-off films directly to the first washing tray in which washing liquid has been replaced by activator in advance, while skipping the processes of developing, stopping and fixing. To enable treatment of both ordinary films and wash-off type films with a processor, therefore, it is necessary to provide film-transfer-routes separately. For the arrangement, therefore, the foregoing second washing tray and drying chamber are provided at the rear part of the first washing tray in addition to the series of the equipments for developing, fixing, stopping and first washing arranged in parallel in the order as stated.

For conventional type of processors for ordinary films and wash-off films, the apparatus must be installed in a dark room because the inlets for insertion of exposed films are provided at both ends thereof, and a large dark room is also required. Films after processing shall also be kept in the dark room. The operations for the film processor extremely troublesome for large sized films.

BRIEF SUMMARY OF THE INVENTION

The primary object of the present invention is to provide a processor that performs processing to different kinds of films.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

DETAILED DESCRIPTION OF THE INVENTION

Figure 1:
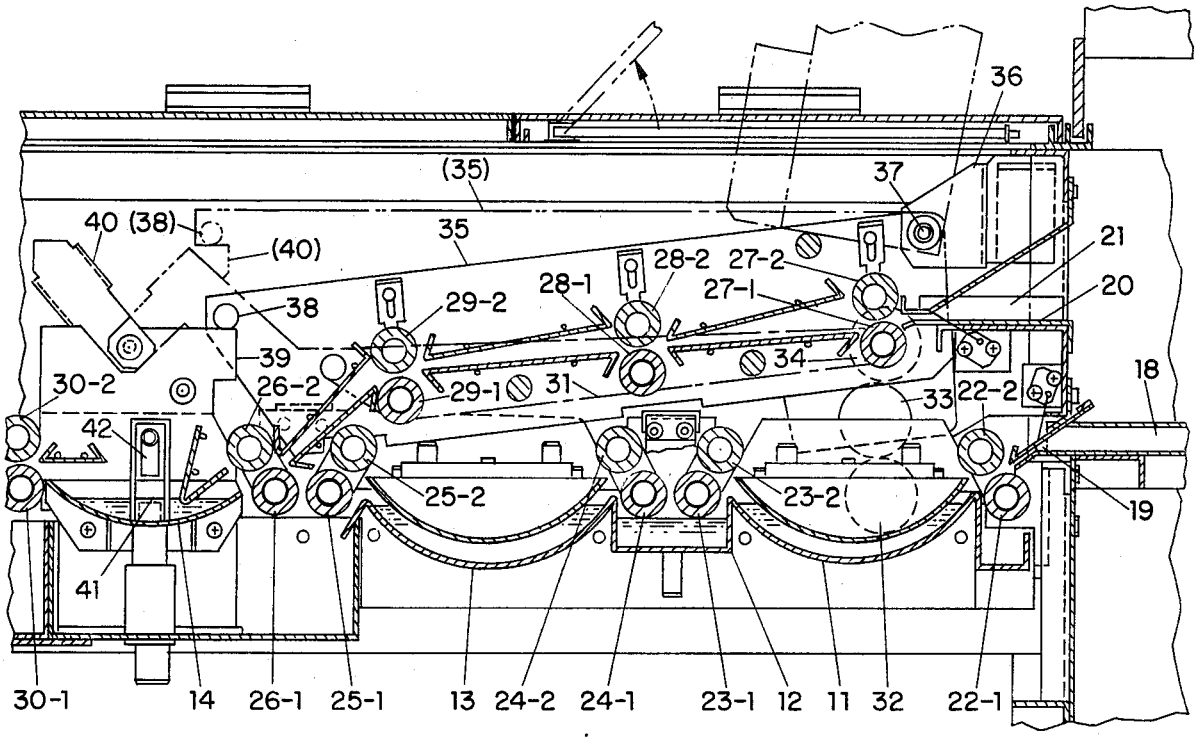
FIG. 1 is a sectional side elevation of the right half of an embodiment according to the present invention.
Figure 2:
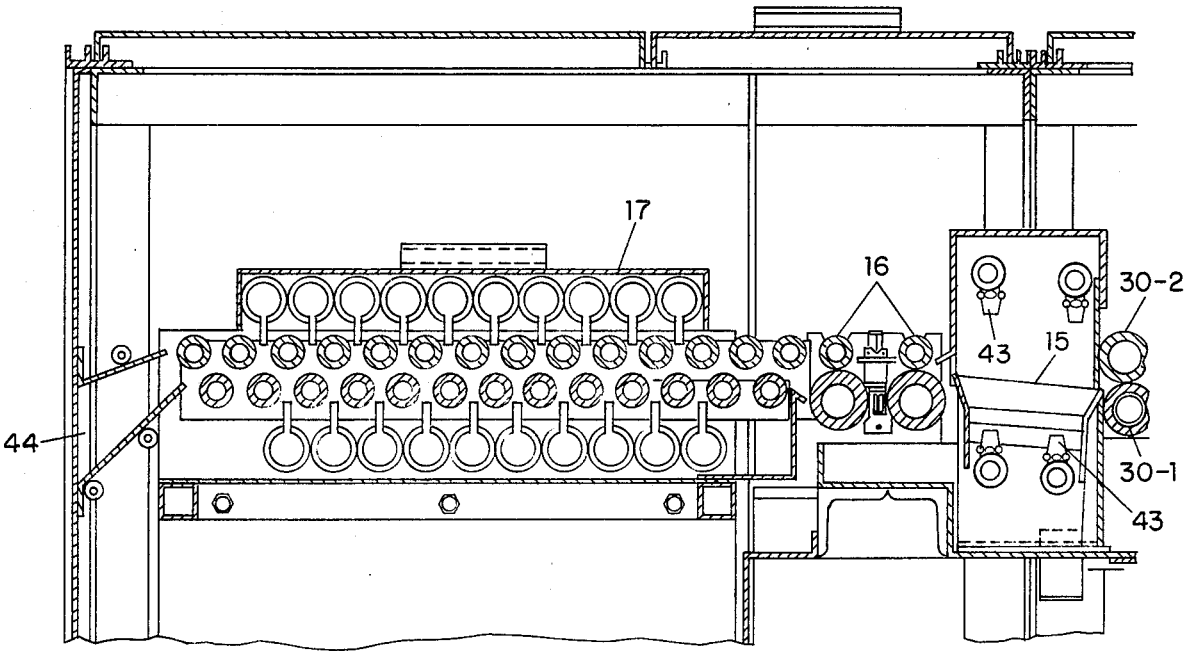
FIG. 2 is a sectional side elevation of the left half of the same embodiment.

Referring to FIG. 1 and FIG. 2, a developing tray 11, a stop bath 12, a fixing tray 13, the first washing tray 14, the second washing unit 15, squeeze rollers 16 and a drying chamber 17 are respectively provided in a film processor. On an end of the processor, an insertion base for ordinary films 18 and an insertion base for wash-off films 20 are respectively mounted, accordingly, ordinary films and wash-off films are respectively inserted through inlets 19, 21. As a matter of course, the insertion bases 18, 20 are provided in a dark room. Film transfer rollers 22-1, 22-2; 23-1, 23-2; 24-1, 24-2; 25-1, 25-2; 26-1, 26-2; 27-1, 27-2; 28-1, 28-2; 29-1, 29-2; 30-1, 30-2 are respectively provided in the each routes of films, and the lower rollers with suffix 1 are driving rollers, and the upper rollers with suffix 2 are driven rollers. Though not shown in the drawings, a worm gear is fixed to the end of each driving shafts, and the rotational driving is made by a known mechanism, which drives the line shaft having worms that interlock with the said worm gears respectively at the corresponding positions by a variable speed geared motor. To the rotary shaft of the driving and driven rollers, gears having the same number of teeth and interlocking each other are fixed respectively, and the said rollers turn at the same rotation speed without slipping.

To each driving shaft of the driving rollers 27-1, 28-1, 29-1, a sprocket is respectively fixed and the endless chain 31 is connected to the sprockets. Since the said driving rollers and the driven rollers in contact with the driving rollers are connected to respective rotation shafts intermediated by mutually interlocked gears, in the same manner as described above, the said driving rollers and driven rollers are turned at the same turning speed without slipping when the driving shaft of the driving roller 27-1 is driven and turned. The driving shaft of the driving roller 27-1 turns when the gear 34 fixed to the shaft is turned intermediated by the gear 32 which is driven by the said line shaft through the interlocking of the worm gear and also intermediated by the middle gear 33 interlocked with the said gear 32. Accordingly, all of the said film transfer rollers are so arranged to make simultaneous rotation at the specified rate of rotation by controlling the rotation speed of the said line shaft, and therefore, to transfer films at the same and specified speed.

Guide plates with larger span than film width are provided respectively between the film inlets 19, 21, and between the transfer rollers 27, 28; 28, 29; 29, 26. The film transfer mechanism connected to the inlet for wash-off films 21, i.e. the separate transferring route to transfer wash-off films directly to the first washing tray 14, is composed of the transfer rollers 27, 28, 29 and of the said guide plates arranged between the transfer rollers and adjacent to the transfer rollers. Since the support plate 35 to which the film by-pass mechanism is assembled is connected to the support bracket 36 so as to turn freely intermediated by the rotary shaft 37, the film by-pass mechanism can be raised taking the rotary shaft 37 as the fulcrum point while turning it clockwise when the supporting rod 38 placed at the upper left corner of the support plate 35 is held up. At the position as illustrated, the said film by-pass mechanism is in the condition that the supporting rod 38 is placed on the upper end of the support plate 39 and so set that the wash-off film inserted through the inlet for wash-off film 21 is transfered to the first washing tray 14 directly through the transfer roller 26. A support fitting 40 is connected with the support plate 39 so as to turn freely. When the support rod 38 is held up, the support plate 35 is raised, then the support fitting 40 is turned clockwise, and the lower corner of the bent section is put in contact with the support plate 39 as shown by the alternate long and two dashes line so as to place the support rod 38 on the support fitting 40, the support plate 35 is kept at the horizontal position shown by the alternate long and two dashes line. By this operation, the said transfer route of wash-off films can be separated from the transfer route of ordinary films composed of the transfer rollers 22, 23, 24, 25, 26, and the interference between the two route can be avoided. In this case, the middle gear 33 is also raised and the interlocking with the gear 32 is disengaged.

An over-flow pipe 41 is provided at the end side in width direction of the first washing tray 14 and is mounted on the drain pipe so as to be detached freely. The faucet of supply pipe 42 feeds washing water or activator to the said tray 14 as desired by switching. The transfer rollers 23, 24 function to transfer the films treated in the developing tray 11 to the fixing tray 13 and also to apply stopping liquid to the films at the same time, when the stop bath 12 is filled with stopping liquid to the level that the driving rollers 23-1, 24-1 are fully immersed.

The second washing unit 15 is composed of the guide bars provided in hurdle form on the rectangular frame, and from a number of nozzles 43 attached with equal spacing to two each of the upper and lower feed water pipes which are provided perpendicular to the said guide bars, washing water is sprayed to be blasted to the said guide bars from both upper and lower directions.

In the drying chamber, feed rollers are arranged in zigzag form, and to the rotary shafts sprockets are fixed respectively, in which an endless chain is set. The upper rollers turn in clockwise direction and the lower rollers in counter-clockwise direction, all at the same rate of rotation. The film feeding speed by these feed rollers is synchronized with the transfer speed of the said film transfer rollers. When the lower rollers of the squeezing unit 16 are driven, the upper rollers come in contact with the lower rollers because of their own weight and are turned freely. The outlet of the films 44 which is dried in the drying chamber 17 is provided at the other end of the film processor.

Now follows the description on the operation of this embodiment.

PROCESSING FOR ORDINARY FILMS

In this case, open the upper cover which can be mounted or dismounted freely, place the support rod 38 on the support fitting 40 turned to the position shown by the alternate long and two short dashes line, hold the support plate 35 at the horizontal position as shown by the alternate long and two short dashes line, then close the said cover after separating upward the transfer route for wash-off films. Place an ordinary film after being exposed on the ordinary film insertion base 18 provided in a dark room, then push the film into the inlet 19. When the front end of the inserted film comes in contact with the feeler of the limit switch, the group of transfer rollers and feed rollers preliminary operated in slow speed are accelerated to the specified and preset rate of rotation for synchronous driving. At the same time, washing water sprayed from the nozzles 43 of the second washing unit 15, and hot air blasted from the drying chamber 17 to the spaces between rollers. The film is transferred from the inlet 19 to the developing tray 11 by the transfer rollers 22 and emmersed through the developing liquid for treatment, then raised by the transfer rollers 23, and finally transferred to the fixing tray 13 by the transfer rollers 24. During the process, the film surface is subjected to the application of stopping liquid intermediated by the transfer rollers 23,24. When the development is stopped, the film is immersed into the fixing liquid, then transferred to the first washing tray 14 by the transfer rollers 25, 26 for washing treatment. After washing, the film is transferred to the second washing unit 15 by the transfer rollers 30, where washing water is showered to both upper and lower faces from the nozzles 43 for full washing. The washed film is then squeezed by the squeeze rollers 16 to remove remaining water on the surface thereof and transferred to the drying chamber 17 to be dried by the hot air blasted through the spaces between the rollers while it is transferred by the feed rollers. At the end, the ordinary film completely treated is discharged outside from the outlet 44.

PROCESSING FOR WASH-OFF FILMS

In this case, open the upper cover which can be mounted or dismounted freely, return the support plate 35 kept at the horizontal position shown by the alternate long and two dashes line in preparation for processing of ordinary film to the position shown by the continuous line in the drawing, then connect the by-pass mechanism for wash-off film to the transfer roller 26. Then pull out the over-flow pipe 41 of the first washing tray 14 from the drain pipe by the knob fixed to the over-flow pipe. After discharging the washing water in the said tray 14 completely, reset the over-flow pipe 41 at the original position, and supply activator from the faucet 42 of the feed pipe. At the same time, change the pipe route so as the over-flown activator returns to the cubitainer of the activator from the discharge pipe and to circulate between the said cubitainer and the said tray 14, then close the said cover. Place an exposed wash-off film on the insertion base 20 for wash-off films provided in the dark room, then insert the film into the inlet. When the inserted film comes in contact with the feeler of the limit switch on the front end, the same motion like in the case of the above ordinary film insertion is made by this inserting motion to the group of transfer rollers, feed rollers, and to the second washing unit 15 and the drying chamber 17. Intermediated by the transfer rollers 27, 28, 29, 26 and also by the guide plates between the rollers, the film is transferred directly into the first washing tray 14, which is filled fully with activator, for developing treatment. Then follow the washing, squeezing of extra water, and drying one after another in the same manner as for the case of the said ordinary film, and the wash-off film completely treated is discharged outside from the outlet 44.

To facilitate internal inspection and maintenance, the support plate 35 to which the transfer mechanism exclusively used for wash-off film is assembled, can be pulled up completely to outside toward the upper right, as shown by the alternate long and two short dashes line, taking the rotary shaft 37 as the fulcrum point, and the support rod housed in the upper cover can be raised and be fixed to the support plate 35.

Figure 3:
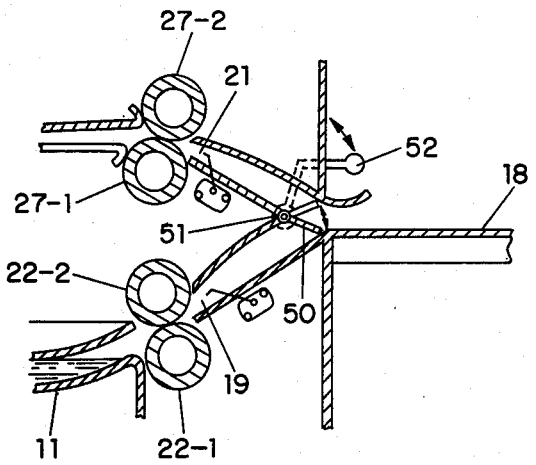
FIG. 3 is a partially sectional view of another embodiment according to this invention.

Referring to FIG. 3, which shows another embodiment according to the present invention, it is also possible to bifurcate the insertion base 18 into two inlets 19, 21. In other words, the switching guide 50 turns upward (the side shown by the alternate long and two dashes line) around the rotary shaft 51, when the lever 52 is pulled upward, and a film is inserted into the inlet 19. Likewise, when the lever 52 is pushed downward, the switching guide 50 turns downward (to the side shown by the thick line), a film is inserted to the inlet 21. It is also possible to change-over the switching guide 50 in this case by replacing the lever 52 with a magnet, air-cylinder and the like.

As it has been made clear by the above description, the film processor according to this invention has two inlets into which ordinary films and wash-off films are inserted separately, at the same side of the processor so as the different kinds of films that require different processing treatments are handled, and also has respective film transfer mechanisms being connected to the said inlets so as the films are respectively passed through the required processes of treatment separately and without interfering each other. Accordingly, only the side of the said film inlets side is placed in a dark room and all the other parts can be placed outside. This can eliminate the difficulty in operating conventional type of film processors of this kind due to the necessity to place the whole equipment in a dark room.

Though the above description has been given on the case where wash-off films are used jointly with ordinary films, this invention is naturally applicable to other cases where similar films other than wash-off type for single bath processing treatment are used together with ordinary films.

What is claimed is:

1. Apparatus for processing films comprising:

a processing route having a plurality of different processing sections for processing an exposed ordinary film and means for transferring the exposed ordinary film continuously along the processing route from one processing section to the next;

first film inlet means for communicating film inserted therein to said transferring means for transferring film along the entire processing route;

second film inlet means; and by-pass transferring means for receiving film from said second inlet means and for delivering film to said transferring means for by-passing at least one processing section; wherein film requiring only a single-bath developing treatment and washing is transferred via said by-pass transferring means through only a portion of said processing route.

2. Apparatus according to claim 1, wherein said processing route includes at least one washing section, wherein said by-pass transferring means is arranged to deliver film directly to said washing section, and wherein said washing section, when used to process a film requiring only a single-bath developing treatment, is supplied with activating fluid.

3. Apparatus according to claim 2, wherein the by-pass transferring means is movable from a first position, for delivering film from said second inlet means to said transferring means, to a second position to prevent interference with the processing route when an ordinary film is being processed.

4. Apparatus according to claim 3, wherein said by-pass transferring means is mounted on a mounting member having one end rotatably supported by the apparatus for moving said by-pass transferring means between said first and second positions.

5. Apparatus according to claims 1, 2, 3, or 4, wherein said first and second film inlet means are formed by a bifurcated insertion member for selectively delivering film to one of said transferring means and said by-pass transferring means.

6. Apparatus according to claim 5, wherein said first and second film inlet means include a switching member operable to close either one of the film inlets.

* * * * *